United States Patent [19]

Lebacqz

[11] 4,210,845

[45] Jul. 1, 1980

[54] TRIROTRON: TRIODE ROTATING BEAM RADIO FREQUENCY AMPLIFIER

[75] Inventor: Jean V. Lebacqz, Stanford, Calif.

[73] Assignee: The United States of America as represented by the United States Department of Energy, Washington, D.C.

[21] Appl. No.: 963,495

[22] Filed: Nov. 24, 1978

[51] Int. Cl.[2] ..... H01J 25/22

[52] U.S. Cl. ..... 315/5.25; 315/5; 315/5.13; 315/5.26; 315/39; 330/44

[58] Field of Search ..... 315/5.13, 5.24, 5.25, 315/5.26, 5.27, 5.28, 39, 4, 5, 39.3; 330/44

[56] References Cited

U.S. PATENT DOCUMENTS

| | | | |
|---|---|---|---|
| 2,835,844 | 5/1958 | McBride, Jr. | 315/5.27 |
| 2,870,374 | 1/1959 | Papp | 315/39 |
| 3,221,207 | 11/1965 | Kaufman et al. | 315/5.25 |
| 3,254,261 | 5/1966 | Sturrock | 315/5.13 X |
| 3,273,011 | 9/1966 | Brown | 315/34 X |
| 3,305,752 | 2/1967 | Friz | 315/5 X |
| 3,450,931 | 6/1969 | Feinstein et al. | 315/5.13 X |

*Primary Examiner*—Saxfield Chatmon, Jr.
*Attorney, Agent, or Firm*—R. V. Lupo; Roger S. Gaither; Clifton E. Clouse, Jr.

[57] ABSTRACT

High efficiency amplification of radio frequencies to very high power levels including: establishing a cylindrical cloud of electrons; establishing an electrical field surrounding and coaxial with the electron cloud to bias the electrons to remain in the cloud; establishing a rotating electrical field that surrounds and is coaxial with the steady field, the circular path of the rotating field being one wavelength long, whereby the peak of one phase of the rotating field is used to accelerate electrons in a beam through the bias field in synchronism with the peak of the rotating field so that there is a beam of electrons continuously extracted from the cloud and rotating with the peak; establishing a steady electrical field that surrounds and is coaxial with the rotating field for high-energy radial acceleration of the rotating beam of electrons; and resonating the rotating beam of electrons within a space surrounding the second field, the space being selected to have a phase velocity equal to that of the rotating field to thereby produce a high-power output at the frequency of the rotating field.

16 Claims, 3 Drawing Figures

TRIROTRON: TRIODE ROTATING BEAM RADIO FREQUENCY AMPLIFIER

BACKGROUND OF THE INVENTION

The invention disclosed herein was made under, or in, the course of United States Department of Energy Contract No. EY-76-C-03-0515 with Stanford University.

The present invention relates to radio-frequency amplifiers, and more particularly it relates to a high-power, high-efficiency radio-frequency amplifier utilizing a rotating beam of electrons.

Rotating beam radio-frequency amplifiers are known in the art, such as those disclosed in U.S. Pat. No. 2,408,437, issued Oct. 1, 1946, to James W. McRae; U.S. Pat. No. 3,219,873, issued Nov. 23, 1965, to Irving Kaufman; and U.S. Pat. No. 3,885,193, issued May 20, 1975, to Budker et al. Such devices are useful in producing very high-power levels such as required in accelerators, storage rings and fusion devices; and at these high-power levels efficiency is of major importance. In a report by Paul J. Tallerico, *A Class of Deflection-Modulated, High-Power Microwave Amplifiers*, U.S. Department of Energy technical report No. LA-UR 77 2255, Los Alamos Scientific Laboratory, University of California, Los Alamos, N. Mex., his analysis indicates electronic efficiencies from 80–90% for rotating beam radio-frequency amplifiers. In each of these prior art arrangements, electrons are emitted in a beam from a cathode, the beam is accelerated, and then deflected to cause rotation so that the beam describes a generally conical shape. The beam impinges on an annular output cavity having a slit to receive the electron beam which induces an output signal therein. In some of these arrangements, additional static deflection means, which may be magnetic or capacitive, are provided for more accurately focusing the beam into the slit in the output cavity. However, several problems are present in these prior art conical beam arrangements. The beam is given its rotation by means of two pairs of deflection fields positioned in quadrature and driven in phase quadrature to impart circular rotation to the beam so that it traverses the cavity slit. With such an arrangement, it is difficult to impart precise circular motion to the beam and still maintain the beam in focus so that it precisely passes through the slit. Additional magnetic or capacitive deflection or bending means is provided in the prior art to better focus the beam. However, since the beam is a "stiff" very high energy beam, such bending is accomplished by means which is inconveniently large, such as a high-power electromagnet, a large permanent magnet or a large capacitive arrangement with attendant power supply. Moreover, such bending results in beam spreading, especially at high power levels.

SUMMARY OF THE INVENTION

In brief, the invention relates to a rotating beam radio-frequency amplifier, including: a cathode for producing electrons; radio-frequency input means for forming the electrons into a beam with the aid of either electric or magnetic bias fields or both, and rotating the beam around the cathode; means for adding energy to the beam during its rotation; and output means for extracting the energy of the beam.

It is an object of the invention to very efficiently amplify radio frequencies to very high power levels.

Another object is to eliminate radio-frequency beam deflection and focusing problems such as found in prior art rotating beam radio-frequency amplifiers.

Another object is to arrange the geometry of a rotating beam radio-frequency amplifier to obtain high power levels with minimal structure that is simple to construct, low in cost, and that permits optimization of parameters with ease.

Another object of the invention is to amplify radio frequencies, with efficiencies of over 80%.

Another object is to rotate the beam in a rotating beam radio-frequency amplifier by means of a radio-frequency field propagating through a microwave cavity ring.

Other objects and advantageous features of the invention will be apparent in a description of a specific embodiment thereof, given by way of example only, to enable one skilled in the art to readily practice the invention which is described hereinafter with reference to the accompanying drawing.

DETAILED DESCRIPTION OF THE INVENTION

Reference will now be made in detail to the present preferred embodiment of the invention, an example of which is illustrated in the accompanying drawing.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined in the appended claims.

Figure 1:
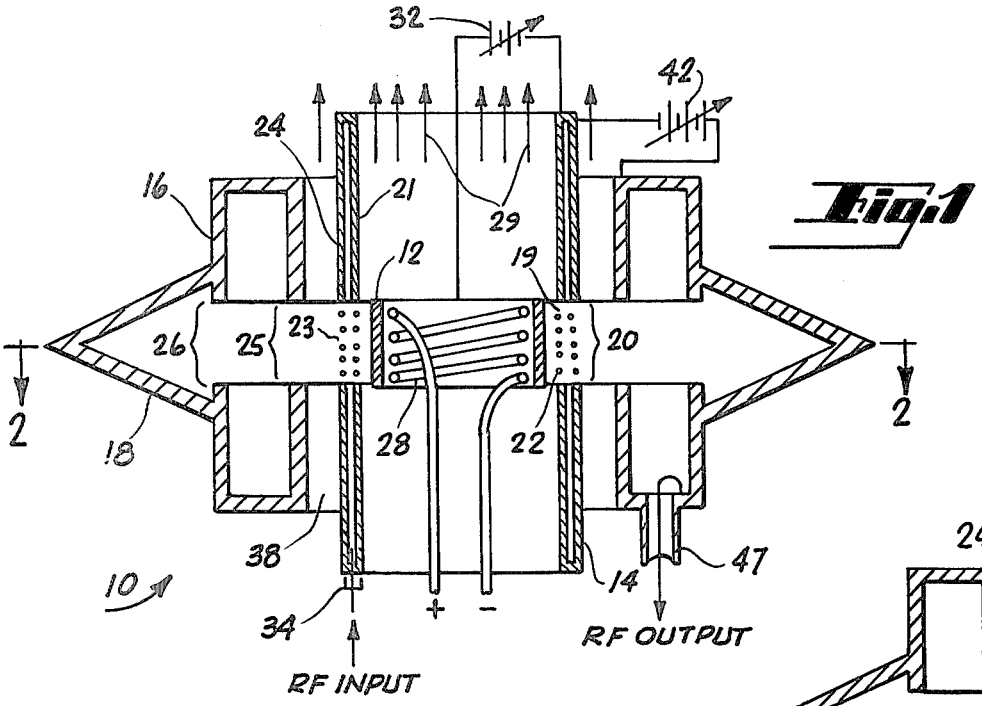
FIG. 1 is a cross-sectional view of a triode rotating beam radio-frequency amplifier, according to the invention.

Referring to the drawing, there is shown in FIG. 1 a triode rotating beam radio-frequency amplifier 10 including an annular cylindrical cathode 12, an input waveguide 14 that is formed in an annular shape having a larger diameter than the cathode and positioned around and coaxial with the cathode, an output waveguide 16 that also is annularly shaped and having a larger diameter than the input waveguide 14, and an annularly shaped collector 18 positioned coaxially around the outer wall of the output waveguide 16. The input waveguide 14 is formed with slots 19 and 20 in the central section of inner and outer walls 21 and 24, respectively, that are opposite and generally in line with the outer cylindrical surface of the cathode 12. Grids 22 and 23 may be mounted within the slots 19 and 20 to be electrically coincident with the inner and outer walls 21 and 24, respectively, of the waveguide 14. The output waveguide 16 is provided with slots 25 and 26 in the inner and outer walls, respectively, that are in line with the cathode 12 and slots 19 and 20.

Figure 2:
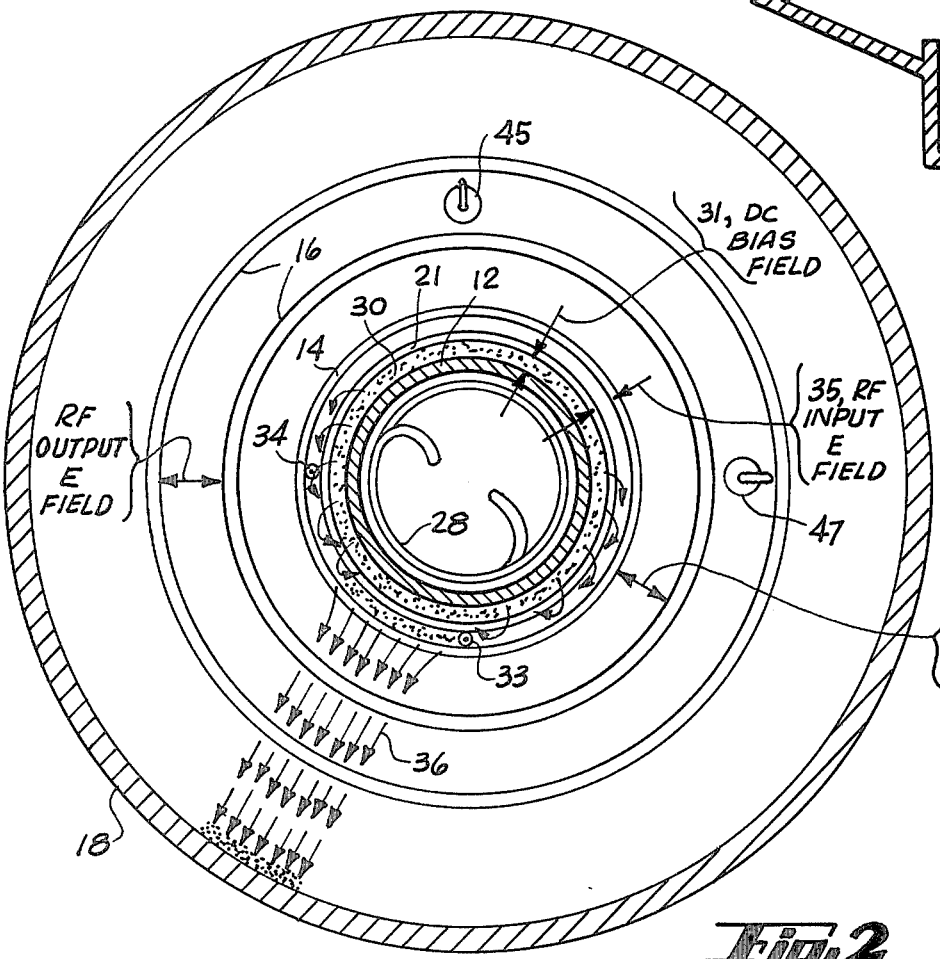
FIG. 2 is a full plan view of the amplifier of FIG. 1 taken along lines 2—2.

In operation of the amplifier 10, the cathode 12 may be heated such as with a heater 28 to its electron emission temperature whereby an electron cloud 30 (FIG. 2) is formed in the space between the cathode and the inner wall 21 of the waveguide 14. The electrons are normally contained in this space by means of a direct current bias field 31 created with a source 32 connected across the cathode 12 and waveguide 14. The cathode 12 and input waveguide 14 may also be immersed in an axial biasing magnetic field 29 for further control in the confinement of electrons in this space.

The radio frequencies to be amplified are applied to the input waveguide 14 at RF input connections 33 and 34 so that an RF input E field 35 is established and forms a traveling wave in the guide. The circular length of the input waveguide 14 is selected to be precisely the length of the radio-frequency wave to be amplified. Thus, as the input radio wave propagates around the guide 14, one half of the wave reinforces the bias field and the other half opposes the bias field at any particular instant. Around the peak of the opposing half of the wave, the bias field is overcome to the extent that electrons are accelerated from the cloud 30 in a beam 36. The source 32 may be adjusted to control the beam 36 to be of the optimum width. Another way of adjusting the width of the beam 36 to its optimum value is by adjustment of the magnetic field 29. Thus, control of both the magnitude and width of the beam 36 is accomplished easily by adjustment of the D.C. bias electric field 32 and the bias magnetic field 29. Since the walls 21 and 24 of the guide 14 are provided with grids 22 and 23, respectively, the beam 36 is free to pass through the guide 14 into a space 38 between the guides 14 and 16. A direct current acceleration field 40 (FIG. 2) is established throughout the space 38 by means of a source 42 connected across the guides 14 and 16. The electrons in the beam 36 may be accelerated by the field 40 to very high energy levels. The accelerated beam passes through the slots 25 and 26 in the output wave guide 16 thereby inducing an RF output frequency in the form of a traveling wave in the guide 16. The guide 16 is selected to have a phase velocity that is equal to the angular velocity of the beam 36 so that the output frequency is at the frequency of the rotating field of the input frequency. The induced output wave is extracted from the guide 16 for application to a load through RF output terminals 45 and 47. The electrons in the beam 36 are collected on the collector 18 after extraction of most of their energy in the guide 16. The electrons are decelerated in the guide 16 until they reach the outer wall of the guide 16 with a velocity substantially equal to 0. Thus, since nearly all of the energy in beam 36 is given up in the guide 16, the amplifier 10 has a very high efficiency.

Figure 3:
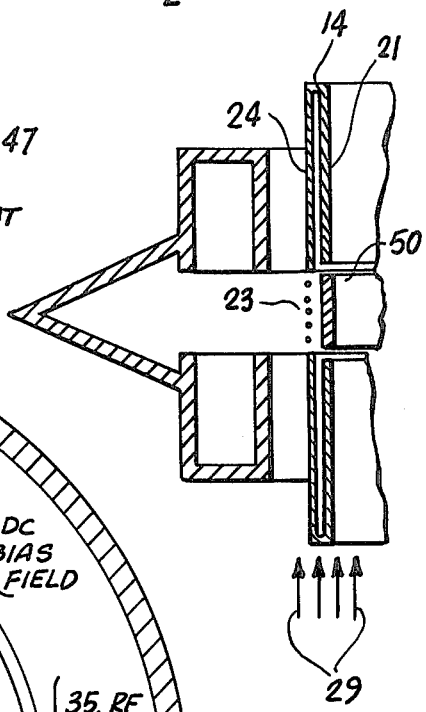
FIG. 3 is a partial view in cross section of a triode rotating beam amplifier in which a multipactor cathode is utilized.

In an alternative embodiment of the invention, it may be found desirable to further increase the efficiency of the amplifier 10 by utilizing a multipactor cathode instead of the thermionic cathode 12. The angle of emission of a thermionic cathode may be as high as 90°, while the angle of emission from the input to output waveguides for a multipactor cathode is less than 5°. The amplifier 10 is shown in FIG. 3 provided with a multipactor cathode 50 having a diameter such that the emitting surface of the cathode 50 coincides with the inner surface of the wall 21 of guide 14. In this arrangement, the grid 19 and bias source 32 are no longer required. In order to sustain multipactoring, the material for the surface of the grid 23 and cathode 50 may be various materials such as nickel, platinum, barium oxide, strontium and calcium impregnated materials, tungsten, or sintered alloys, chosen so that there is secondary emission greater than one between the grid 23 and cathode 50 or for the cathode alone; and the gap between the walls 21 and 24 is chosen so that the transit time is ½ the period of the RF input frequency. Alternatively, the cathode 50 may be a thermionic instead of a multipactor cathode. In addition, it may be desirable, whether the cathode 50 is a thermionic or multipactor cathode, to further control the current drawn from the cathode, in particular to increase the width and therefore the maximum current of the beam 36, by including the magnetic field 29.

In an embodiment of the invention for amplifying frequencies of 353 MHZ useful in the Positron Electron Project (PEP) at the Stanford Linear Accelerator Center, the following dimensions may be used:

Cathode 12 diameter—10 to 12″
Cathode 12 wall thickness—¼″
Cathode 12 height—2½ to 4″
Waveguide 14 gap—0.4″
Waveguide 14 height—32″
Waveguide 14 circular length—40″
Width of Slots 19 and 20—3 to 4″
Width of space 38—¾″
Waveguide 16 gap—4″
Waveguide 16 height—20″
Waveguide 16 circular length—62½″
Width of Slots 25 and 26—3″
Outer Diameter of Collector 18—36″
Range of Bias DC Field 32—0 to 2000 Volts
Range of Bias Magnetic Field 33—0 to 200 gauss
Range of Source 42—50 to 65 KV
RF Power Input—10 KW
RF Power Output—600 KW While embodiments of the invention have been shown and described, further embodiments or combinations of those described herein will be apparent to those skilled in the art without departing from the spirit of the invention. For example, the input waveguide 14 may be energized to sustain some integral multiple of the input frequency in order to form more than one beam from the cathode.

What is claimed is:

1. A rotating beam radio-frequency amplifier, including:

a cylindrical cathode having an outer curved surface for producing electrons;

radio-frequency waveguide input means including means for establishing a traveling wave for forming said electrons into a beam and rotating said beam around said cathode;

means for adding energy to said beam during said rotation; and output means for extracting the energy of the beam, said input and output means including waveguides that support traveling waves at a frequency that is an integral multiple of one or more of the frequency of said established traveling wave.

2. The amplifier of claim 1, wherein said waveguide input means includes a circular ring-shaped waveguide positioned coaxial and coplanar with said cathode, said waveguide having an inner wall and an outer wall, each of said walls having a central section that is transparent to the passage of electrons therethrough.

3. The amplifier of claim 2, further including means for thermionically heating said cathode to produce a cloud of electrons thereabout, said cathode being spaced apart from said waveguide to form an annular space therebetween.

4. The amplifier of claim 3, further including biasing means for confining said cloud of electrons in the space between said cathode and said waveguide to control the angular width and magnitude of the beam.

5. The amplifier of claim 4, wherein said biasing means includes electric field means.

6. The amplifier of claim 4, wherein said biasing means includes magnetic field means.

7. The amplifier of claim 4, wherein said biasing means includes electric and magnetic field means.

8. The amplifier of claim 2, further including first and second grids mounted in the central section of said inner and outer walls respectively of said waveguide.

9. The amplifier of claim 2, wherein said outer surface of said cathode is coincident with said inner wall of said waveguide and is within the central section of said inner wall.

10. The amplifier of claim 1, wherein said means for adding energy to the beam includes a direct current potential source connected across said waveguide input means and said output means.

11. A method for amplifying radio-frequencies, including the steps of:

developing a cylindrical cloud of electrons;

supporting an input traveling wave at a frequency that is an integral multiple of one or more of the frequency of the traveling wave;

applying the rotating electrical field of the traveling wave to the cloud of electrons to extract electrons therefrom and form them into a beam rotating around the cloud in synchronism with the rotating field, all positions of the rotating beam being coplanar with the cloud;

adding energy to the beam of electrons to form a high-energy beam;

developing and supporting an output traveling wave in response to the high-energy beam at the same frequency as the frequency of the input traveling wave; and extracting energy from the traveling wave to produce a high power level radio frequency.

12. The method of claim 11, wherein said electron cloud is thermionically produced.

13. The method of claim 11, wherein said electron cloud is developed by utilizing the rotating electrical field to produce multipactoring.

14. The method of claim 11, wherein a bias field is utilized to confine the electrons to the cloud.

15. The method of claim 14, wherein the bias field is a direct current field.

16. The method of claim 15, wherein the bias field is a magnetic field.

* * * * *